United States Patent [19]

Voss

[11] Patent Number: 5,029,630

[45] Date of Patent: Jul. 9, 1991

[54] DIFFERENTIAL PRESSURE, COUNTERGRAVITY CASTING APPARATUS USING A VERTICALLY PARTED MOLD STACK CLAMP MECHANISM

[75] Inventor: Karl D. Voss, Standish, Mich.

[73] Assignee: General Motors Corporation, Detroit, Mich.

[21] Appl. No.: 630,410

[22] Filed: Dec. 19, 1990

Related U.S. Application Data

[63] Continuation of Ser. No. 547,940, Jul. 3, 1990, abandoned.

[51] Int. Cl.[5] ..... B22D 18/06

[52] U.S. Cl. ..... 164/255; 164/341

[58] Field of Search ..... 164/255, 341, 306, 63, 164/119, 137

[56] References Cited

U.S. PATENT DOCUMENTS

| | | | |
|---|---|---|---|
| 318,206 | 5/1885 | Reese . | |
| 1,542,637 | 6/1925 | Pettis . | |
| 4,340,108 | 7/1982 | Chandley et al. | 164/63 |
| 4,606,396 | 8/1986 | Chandley et al. | 164/255 |
| 4,809,767 | 3/1989 | Voss et al. | 164/255 X |
| 4,825,933 | 5/1989 | Voss et al. | 164/255 |
| 4,828,011 | 5/1989 | Hafer et al. | 164/255 |
| 4,858,672 | 8/1989 | Chandley | 164/255 X |
| 4,932,461 | 6/1990 | Schaffer et al. | 164/255 |
| 4,957,153 | 9/1990 | Chandley | 164/7.1 |

*Primary Examiner*—J. Reed Batten, Jr.

*Attorney, Agent, or Firm*—Reising, Ethington, Barnard, Perry & Milton

[57] ABSTRACT

Differential pressure, countergravity casting apparatus includes a vertically-parted mold stack comprising a plurality of side-by-side mold members disposed on an underlying mold drag. First and second cam shafts are rotatably disposed inside a vacuum box confronting the mold stack and are rotated to engage respective first and second end mold members of the mold stack to clamp the mold stack sealingly together sans glue. Upper ends of the cam shafts extend above the ceiling of the vacuum box and are operatively connected to an actuator linkage for effecting cam shaft rotation in a manner to clamp the mold stack together or in a manner to release the mold stack after casting.

14 Claims, 3 Drawing Sheets

DIFFERENTIAL PRESSURE, COUNTERGRAVITY CASTING APPARATUS USING A VERTICALLY PARTED MOLD STACK CLAMP MECHANISM

This is a continuation of copending application Ser. No. 07/547,940, filed on July 3, 1990, and now abandoned.

FIELD OF THE INVENTION

This invention relates to the vacuum-assisted countergravity casting of molten metal into a mold stack comprised of a plurality of side-by-side mold members and, more particularly, to a countergravity casting apparatus having means in a vacuum box confronting the mold stack for holding the mold stack sealingly together at upstanding parting planes thereof and sealingly against an underlying mold drag.

BACKGROUND OF THE INVENTION

A vacuum-assisted, countergravity casting apparatus using a gas permeable mold is described in the Chandley et al U.S. Pat. No. 4,340,108 issued July 20, 1982 and U.S. Pat. No. 4,606,396 issued Aug. 19, 1986. Typically, the vacuum-assisted, countergravity casting apparatus includes a casting mold having a porous, gas permeable upper mold member (cope) and a lower mold member (drag) sealingly secured together at a common horizontal parting plane, a vacuum box confronting the gas permeable upper mold member and means for immersing the bottom of the lower mold member in an underlying molten metal pool while evacuating the vacuum box to draw the molten metal upwardly through one or more ingate passages in the lower mold member into one or more mold cavities formed between the upper and lower mold members.

Typically, the upper and lower mold members comprise gas permeable, resin-bonded sand mold members which are self-supporting and adhesively secured (glued) together at the common horizontal parting plane to minimize leakage of molten metal at the parting plane.

Improvements in vacuum-assisted, countergravity casting apparatus have eliminated, in some cases, the need to glue such self-supporting upper and lower mold members together at the horizontal parting plane. For example, commonly assigned U.S. Pat. Nos. 4,828,011; 4,809,767; 4,825,933; and 4,858,672 disclose resilient means or rigid means in the vacuum box for pressing the upper mold member into sealing engagement against the lower mold member sans glue at the horizontal parting plane when the mold is mounted to the mouth of the vacuum chamber.

It is an object of the present invention to provide a vacuum-assisted, countergravity casting apparatus wherein a mold stack comprised of a plurality of mold members disposed side-by-side at upright (e.g., vertical) parting planes is disposed atop an underlying mold drag and confronted by a vacuum chamber equipped with cam shaft means therein for holding the mold members in sealed engagement at the parting planes sans glue.

It is still another object of the present invention to provide a vacuum-assisted, countergravity casting apparatus having means for holding a mold stack sealingly engaged against an underlying mold drag while the mold members are held in sealed engagement at upright parting planes between adjacent mold members of the stack.

SUMMARY OF THE INVENTION

The invention contemplates a vacuum-assisted, countergravity casting apparatus wherein the casting mold comprises a mold drag and a mold stack disposed atop the underlying mold drag. The mold stack includes a plurality of gas permeable mold members disposed side-by-side at one or more upright (e.g., vertical) parting planes for defining at least one mold cavity for receiving molten metal from an underlying source via a molten metal inlet in the mold drag. The casting mold is sealingly received in the mouth of a vacuum box having a ceiling overlying the mold and a peripheral wall extending from the ceiling to define a vacuum chamber that confronts the mold stack when the casting mold is sealingly engaged to the peripheral wall.

A cam shaft is disposed in the vacuum chamber adjacent an end mold member of the mold stack while a stop-forming means is disposed in the vacuum chamber adjacent an opposite end mold member of the stack. The cam shaft is mounted for rotation between the mold drag and the vacuum box such that a cam thereon engages the adjacent end mold member upon rotation of the cam shaft by suitable cam shaft rotation means to clamp the mold stack together between the cam and the stop-forming means sans glue at the upright parting planes.

The stop-forming means may comprise a fixed stop member disposed in the vacuum chamber adjacent the opposite end mold member.

Alternately, the stop-forming means may comprise another (second) cam shaft rotatable between the mold drag and the vacuum box. The first and second cam shafts are rotatably mounted in the vacuum chamber adjacent respective first and second end mold members of the mold stack such that respective first and second cams thereon engage the respective first and second end mold members upon rotation of the cam shafts to clamp the mold stack together at the upright parting plane(s) sans glue.

The first and second cam shafts are each operatively associated with rotator means adapted to rotate the cam shafts into engagement with the end mold members to clamp the mold stack together at the parting planes and out of engagement with the end mold members to release the mold stack after casting.

The first and second cam shafts each include a lower end portion received for rotation in a respective recess in the mold drag and an upper portion extending through the ceiling of the vacuum box and rotatably received by bushing means disposed on the ceiling. The rotator means comprises a linkage operatively connected to the upper portions of the cam shafts above the vacuum box for rotating the cam shafts and an actuator for actuating the linkage to rotate the cam shafts in unison.

In another embodiment of the invention, the countergravity casting apparatus also includes biasing means disposed between the ceiling of the vacuum box and the mold stack to bias the bottom of the mold stack sealingly against the mold drag sans glue while the mold stack is clamped together at the upright parting planes by one or more cam shafts.

The aforementioned objects and advantages of the present invention will become more readily apparent from the following detailed description and drawings.

DETAILED DESCRIPTION OF SPECIFIC EMBODIMENTS

Figure 1:
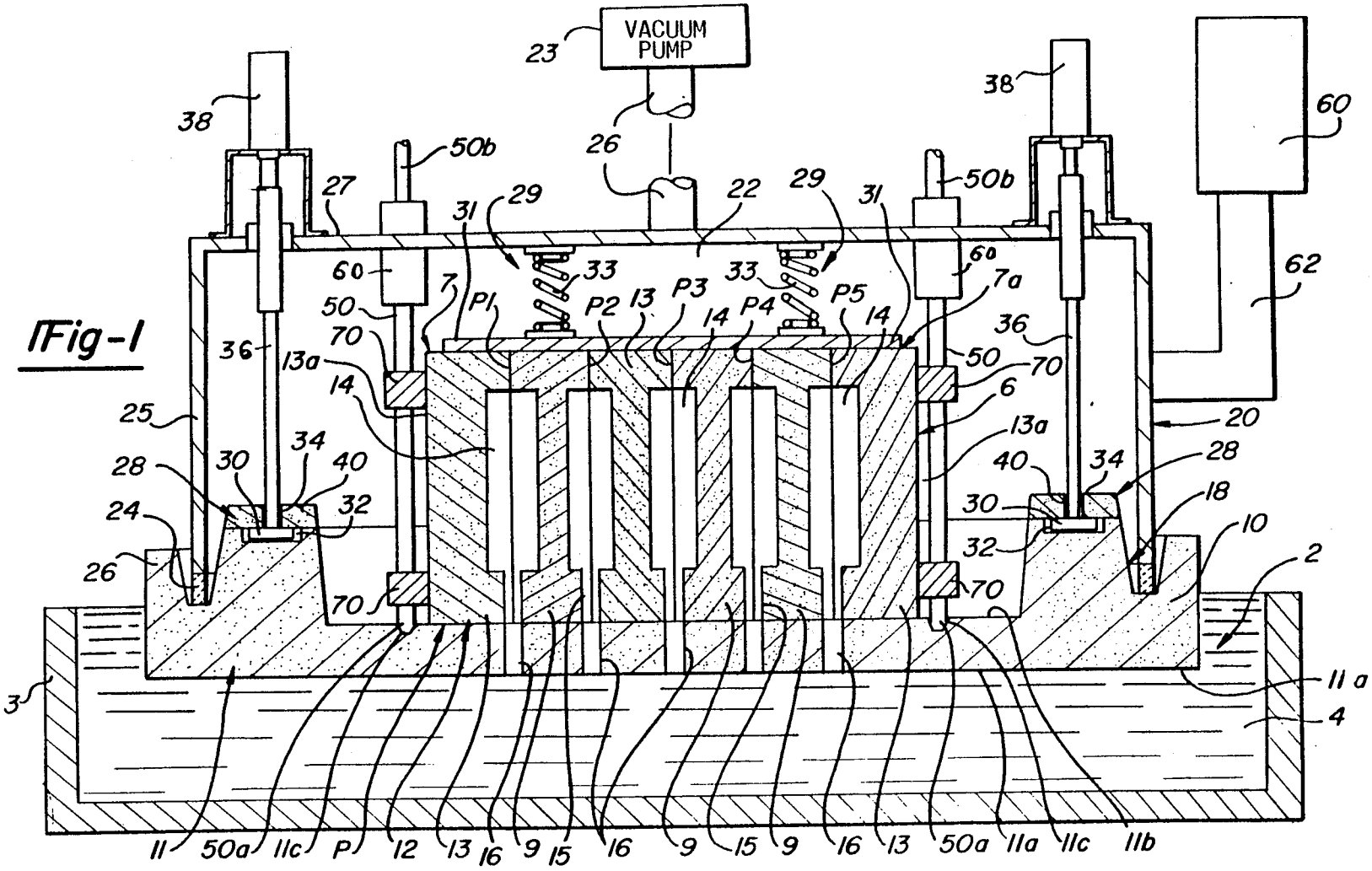
FIG. 1 is a sectioned, side view of a vacuum-assisted countergravity casting apparatus in accordance with invention.

FIG. 1 illustrates one embodiment of a vacuum-assisted, countergravity casting apparatus of the invention. In particular, FIG. 1 depicts a pool 2 of melt 4 (e.g., molten iron) which is to be drawn up into a casting mold 6. The casting mold 6 comprises a gas permeable mold stack 7 disposed on an underlying mold drag 11 at horizontal parting plane P. The mold stack 7 includes a plurality of self-supporting, intermediate mold members 9 disposed between first and second self-supporting, end mold members 13. The mold members 9,13 are disposed side-by-side to define upright (i.e., vertical) parting lines or planes P1 through P5 between adjacent, abutted mold members. A mold cavity 14 and corresponding molten metal ingate 15 are defined between each pair of abutted mold members 9, 13 as shown. The melt 4 is contained in an underlying casting furnace or vessel 3 heated by one or more induction coils (not shown) to maintain the melt 4 at a desired casting temperature.

The mold drag 11 includes a plurality of molten metal inlets 16 extending between its underside 11*a* and top side 11*b* and registered in molten metal flow communication with the respective ingates 15 of the mold stack 7 to supply the melt 4 to the mold cavities 14 when the vacuum box 20 is evacuated with the underside 11*a* immersed in the melt 4 as illustrated in FIG. 1.

The mold drag 11 is sealed to the mouth 18 of the vacuum box 20 via a seal 24 (e.g., high temperature rubber, ceramic rope, etc.). The seal 24 is affixed to the lower edge or lip of the depending peripheral wall 25 of the vacuum box 20 to this end. The peripheral wall 25 and ceiling 27 define a vacuum chamber 22 confronting the mold stack 7 and communicating with a vacuum source 23 (e.g., a vacuum pump) via conduit 26.

The mold members 9,13 of the mold stack 7 comprise a gas permeable material (e.g., resin-bonded sand) which permits gases to be withdrawn from the mold cavities 14 therethrough when a vacuum is drawn in the vacuum chamber 22. The mold drag 11 may conveniently comprise the same material as the mold members 9,13 or other materials, gas permeable or impermeable, which are compatible with the material of the mold members 9,13. The mold members 9,13 and the mold drag 11 typically are each made in accordance with known mold practice where a compliant (shapeable) mixture of sand or equivalent particles and a settable binder material (e.g., an inorganic or organic thermal or chemical setting plastic resin) is formed to shape and then cured or hardened against respective contoured pattern plates (not shown). Alternately, the mold drag 11 could be made of a different material resistant to degradation in the melt 4 to enable repeated use in the casting of multiple disposable mold stacks 7.

The mold drag 11 includes an upstanding levee 26 surrounding the seal 24 and isolating it from the melt 4 for purposes described in U.S. Pat. No. 4,745,962 and assigned to the assignee of the present invention.

The mold drag 11 includes a plurality of anchoring sites 28 engaged by T-bar keepers 30 of the type described in commonly assigned U.S. Pat. No. 4,932,461 disclosing means for mounting a mold to the vacuum box 20. As described in those patent applications, the mold drag 11 includes a plurality of anchoring cavities 32 adapted to receive the T-bar keepers 30 via slots 34 in the shelves 40 overlying the anchoring cavities 32 and attached to the mold drag 11. A 90° rotation of the T-bar carrying shafts 36 (e.g., by air motors 38) causes the T-bar keepers to engage the underside of the attached shelves 40 to secure the mold drag 11 to the vacuum box 20. Other known mold-to-vacuum box mounting means can also be employed in practicing the invention (see U.S. Pat. No. 4,658,880).

Figure 2:
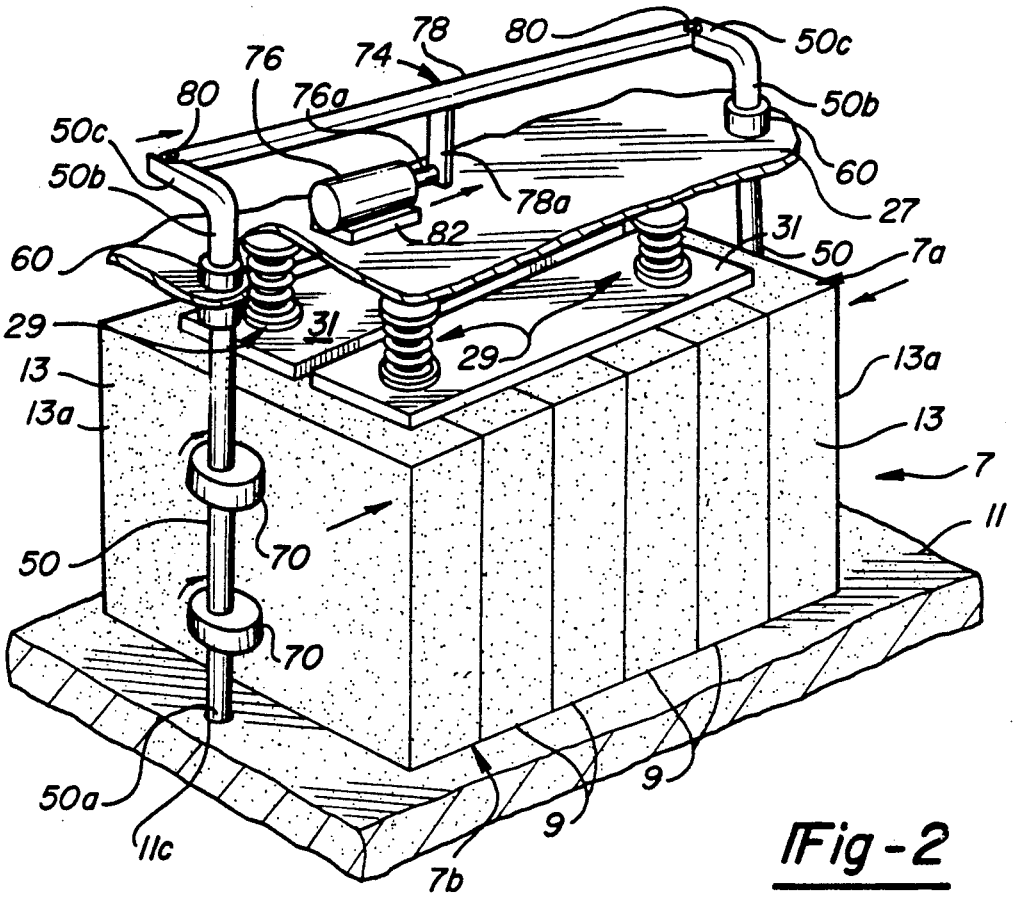
FIG. 2 is a perspective view of the mold stack disposed on the underlying mold drag with the vacuum box broken away to show the cam shafts in clamping positions wherein the cams thereon are in engagement with the end mold members of the mold stack.
Figure 3:
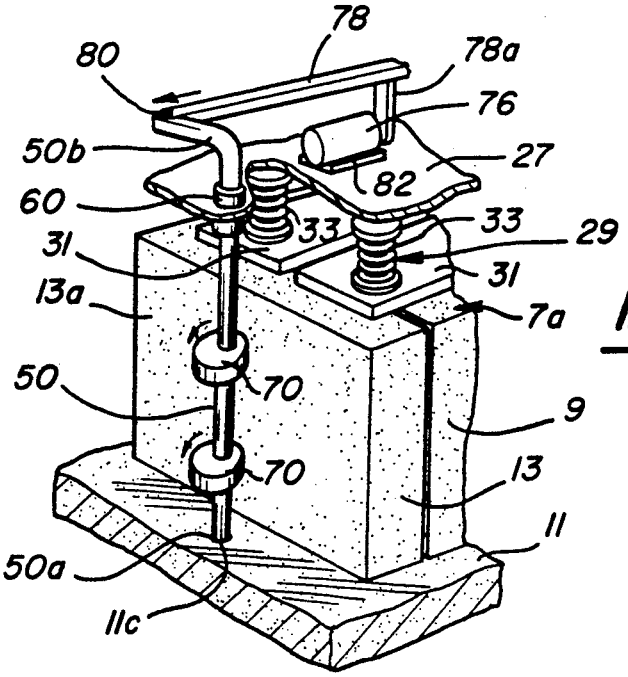
FIG. 3 is a fragmentary perspective view of a portion of FIG. 2 with the cam shafts shown in released positions wherein the cams thereon are out of engagement with the end mold members of the mold stack.

Referring to FIGS. 1–3, in accordance with one embodiment of the invention, first and second upright cam shafts 50 are disposed in the vacuum chamber 22 adjacent and midway of the outer sides 13*a* of the end mold members 13 of the mold stack 7. The cam shafts 50 each include a lower, frusto-conical end portion 50*a* rotatably received in a complementary frusto-conical confinement recess 11*c* formed in the top side 11*b* of the mold drag 11 and an upper portion 50*b* extending through and above the ceiling 27 of the vacuum box 20 via an elongated bushing 60 secured on the ceiling 27. A length of the cam shafts 50 is rotatably received in each bushing 60 in such a manner as to permit the cam shafts 50 to be rotated in the vacuum chamber 22 without substantially reducing the vacuum therein.

Each cam shaft 50 has secured thereto (or integrally formed therewith) a pair of axially spaced apart cams 70 for purposes to be described hereinbelow.

Above the ceiling 27 of the vacuum box 20, the upper portions 50*b* of the cam shafts 50 include rigid, lateral arms 50*c* operatively connected to a rotator means 74 (FIG. 2) comprising an air cylinder 76, an elongated horizontal linkage arm 78 and upright pins 80 pivotably interconnecting each extension 50*c* to a respective end of the linkage arm 78 as shown best in FIG. 2. The air cylinder 76 is secured on a support block 82 affixed on the ceiling 27.

The air cylinder 76 includes a plunger 76*a* that is connected to a flange 78*a* of the linkage arm 78. When horizontally extended (FIG. 2), the plunger 76*a* will cause the cam shafts 50 to be rotated clockwise in unison via the linkage arm 78 and pins 80. When horizontally retracted (FIG. 3), the plunger 76*a* will cause counterclockwise rotation of the cam shafts 50.

In securing the casting mold 6 to the mouth 18 of the vacuum box 20 (FIG. 1), the casting mold 6 and the vacuum box 20 are relatively moved toward one another to insert the T-bar keepers 30 in the anchoring cavities 32. The T-bar keepers 30 are then rotated to engage the underside of the attached shelves 40 of the mold drag 11 in the manner described hereinabove to secure the mold 6 to the vacuum box 20 with the seal 24 engaged with the mold drag 11 and with the vacuum chamber 22 confronting the mold stack 7.

When the casting mold 6 is sealingly secured to the vacuum box 20 in this manner, biasing means 29 disposed between the ceiling 27 and the top 7a of the mold stack 7 biases the mold stack 7 downwardly to sealingly engage sans glue the bottom 7b thereof against the top surface 11b of the mold drag 11. In particular, the coil compression springs 33 bias the hold-down plates 31 downwardly against the top 7a of the mold stack 7. The hold-down plates 31 extend transversely (e.g., perpendicular) of the parting planes P1–P5 such that all the mold members 9,13 are so biased.

In addition, as the mold 6 and the vacuum box 20 move toward one another, the lower end portions 50b of the cam shafts 50 enter and are confined in the confinement recesses 11c in the mold drag 11. The complementary frusto-conical shapes of both the lower end portions 50b and the recesses 11c facilitate location and centering of the cam shafts 50 in the recesses 11b. The cam shafts 50 are thereby rotatably mounted between the recesses 11c and the bushings 60 midway of the outer sides 13a of the end mold members 30, FIG. 2. Prior to securement of the casting mold 6 to the mouth 18 of the vacuum box, the cam shafts 50 are in released positions (see FIG. 3) wherein the cams 70 are out of engagement with the end mold members 13 of the mold stack 7.

Once the casting mold 6 is sealingly secured to the mouth 18 of the vacuum box 20, the cam shafts 50 are rotated in unison by actuation of air motor 76 (i.e., extending the plunger 76a) to cause the cam shafts 50 to move to the clamping positions, FIG. 2, where the cams 70 engage against the outer sides 13a as to clamp the mold members 9,13 in sealing engagement sans glue at the parting planes P1 through P5. The opposing clamping forces exerted by the cams 70 are directed essentially perpendicular to the vertical parting planes P1 through P5 to this end. Typically, the cams 70 are engaged with the end mold members 13 at locations beyond the mold cavities 14 where the mold members 9,13 are devoid of the mold cavities 14.

Those skilled in the art will appreciate that the number, size, shape and location of the cams 70 and the cam shafts 50 relative to the end mold members 13 can be varied to achieve desired clamping of the mold stack 7 together for a particular casting application.

Figure 4:
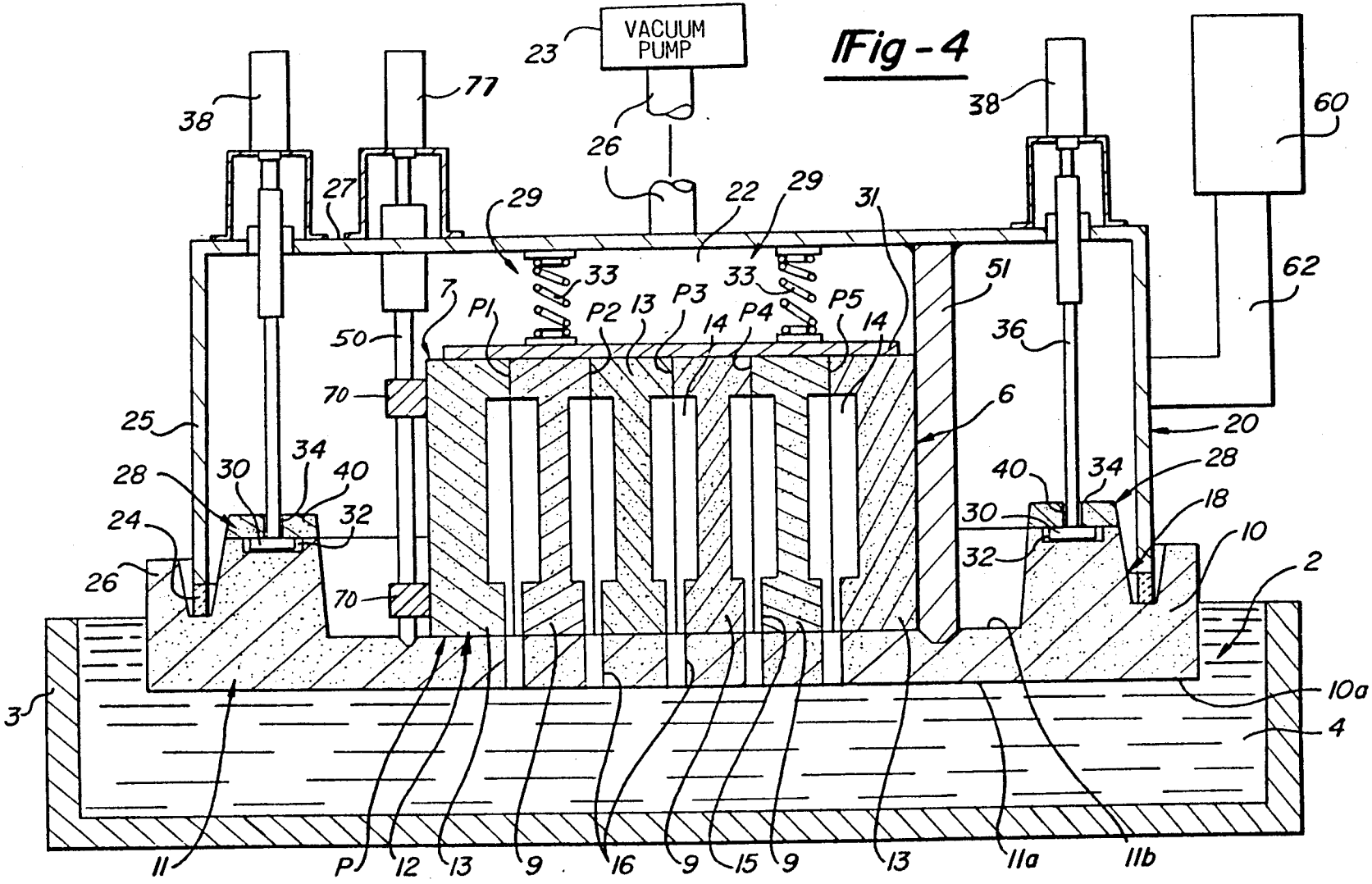
FIG. 4 is a sectioned, side view of a casting apparatus of another embodiment of the invention.

Moreover, those skilled in the art will appreciate that the invention can be practiced using one of the cam shafts 50 for engaging one (left-hand) end mold member 13 and biasing the other (right-hand) end mold member 13 against a stop-forming means such as a fixed elongated stop member 51 disposed between the mold drag 11 and the ceiling 27 of the vacuum box 20 (see FIG. 4 where like features of the previous embodiment are represented by like reference numerals). In this way, the mold members 9,13 can be clamped together at the upright parting planes between the cam shaft 50 and stop member 51, sans glue. In this embodiment of the invention, the cam shaft 50 is rotated by a single air motor 77 to cause the cams 70 thereon to engage against the outer side 13a of the left-hand end mold member 13 of FIG. 4. Those skilled in the art will appreciate that a suitable stop-forming means may alternately be fixedly mounted on the vacuum box 20.

Prior to securing the casting mold 6 to the vacuum box 20 as shown in FIGS. 1–4, the mold stack 7 may optionally be wrapped with a strap or sheet of material, such as a plastic, steel, etc. around the periphery thereof in a manner to maintain the mold members 9,13 in desired alignment with one another at the parting planes Pl through P5 until the cam shaft(s) 50 is (are) rotated to the clamping position(s).

Referring again to FIGS. 1–3, countergravity casting of the melt 4 into the casting mold 6 is effected by relatively moving the vacuum box 20 and the pool 2 to immerse the underside 11a of the mold drag 11 in the melt 4, FIG. 1. Typically, the vacuum box 20 is lowered toward the pool 2 using a hydraulic power cylinder 60 (shown schematically) actuating a movable support arm 62 (shown schematically) that is connected to the vacuum box 20. The vacuum chamber 22 is then evacuated to draw the melt 4 upwardly through the inlets 16 in the mold drag 11 and through the ingates 15 in the mold stack 7 into the mold cavities 14.

After filling the mold cavities 14 with the melt 4 and initial solidification of the melt in the mold ingates 15/inlets 16, the vacuum box 20 and the melt-filled mold 6 sealed thereto are raised by the hydraulic power cylinder 60 to withdraw the underside 11a from the pool 2. The number and size of the ingates 15/inlets 16 to achieve melt solidification initially thereat can be selected in accordance with the teachings of U.S. Pat. No. 4,340,108. Alternatively, the melt 4 can be allowed to solidify in both the ingates 15/inlets 16 and the mold cavities 14 before raising the vacuum box 20 to withdraw the mold drag 11 out of the pool 2.

After removal from the pool 2, the vacuum box 20 and the melt-filled mold 6 secured thereto can be moved to a de-mold station where they are separated. In particular, the cam shafts 50 are rotated by cylinder 76 to the release positions, FIG. 3, wherein the cams 70 are out of engagement with the end mold members 13. The T-bar keepers 30 are then rotated and removed from the anchoring cavities 32 to free the melt-filled mold 6 for separation from the vacuum box 20.

As is apparent, the vacuum, countergravity casting apparatus described hereinabove provides sealing engagement (sans glue) of the mold stack 7 against the mold drag 11 at the horizontal parting plane P and also of the mold members 9,13 with one another at the vertical parting planes P1 through P5 to minimize leakage of molten metal. A vertically-parted mold stack 7 having an increased number of mold cavities 14 available for casting per mold 6 can thereby be used while minimizing leakage of molten metal therefrom.

While the invention has been described in terms of specific embodiments thereof, it is not intended to be limited thereto but rather only to the extent set forth hereafter in the following claims.

I claim:

1. Apparatus for the differential pressure, countergravity casting of molten metal, comprising:

(a) a casting mold comprising a mold drag having a molten metal inlet adapted for communication with an underlying source of the molten metal and a mold stack disposed atop the mold drag, said mold stack including first and second end mold members defining at least one upright parting line therebetween and at least one mold cavity in communication with said inlet for receiving molten metal therefrom, (b) a vacuum box having a ceiling overlying the mold and a peripheral wall extending from the ceiling for defining a vacuum chamber confronting the mold stack, said peripheral wall having a sealing surface for sealingly engaging the mold, and (c) stop-forming means disposed in the vacuum chamber adjacent one of the first and second end mold members, (d) a cam shaft disposed in the vacuum chamber adjacent the other of the first and second end mold members, said cam shaft being mounted for rotation between the mold drag and the vacuum box and having a cam disposed thereon to so engage said other end mold member upon rotation of said cam shaft as to clamp the mold stack laterally together at the upright parting line between said stop-forming means and said cam shaft, and (e) rotator means operatively associated with the cam shaft for rotating said cam into engagement with the second end mold member.

2. The apparatus of claim 1 wherein the cam shaft includes a lower end portion received for rotation in a recess in the mold drag.

3. The apparatus of claim 2 wherein the cam shaft includes an upper portion extending through said ceiling above the vacuum box, said ceiling including bushing means for rotatably receiving a length of said upper cam shaft portion to permit rotation relative to said ceiling.

4. The apparatus of claim 3 wherein the rotator means is operatively connected to said upper cam shaft portion above the vacuum box for rotating said cam shaft.

5. The apparatus of claim 1 further including biasing means disposed between the ceiling of the vacuum box and the mold stack to bias the mold stack against the mold drag.

6. The apparatus of claim 1 wherein the stop-forming means is disposed between the mold drag and the vacuum box.

7. The apparatus of claim 6 wherein the stop-forming means comprises a stationary stop member disposed between the mold drag and the ceiling of the vacuum box.

8. Apparatus for the differential pressure, countergravity casting of molten metal, comprising:

(a) a casting mold comprising a mold drag having a molten metal inlet adapted for communication with an underlying source of the molten metal and a mold stack disposed atop the mold drag, said mold stack including first and second end mold members defining at least one upright parting line therebetween and at least one mold cavity in communication with said inlet for receiving molten metal therefrom, (b) a vacuum box having a ceiling overlying the mold and a peripheral wall extending from the ceiling for defining a vacuum chamber confronting the mold stack, said peripheral wall having a sealing surface for sealingly engaging the mold, and (c) first and second cam shafts disposed in the vacuum chamber adjacent the respective first and second end mold members, said first and second cam shafts being mounted for rotation between the mold drag and the vacuum box and having respective first and second cams disposed thereon to so engage the respective first and second end mold members upon rotation of said cam shafts as to clamp the mold stack laterally together at the upright parting line, and (d) rotator means operatively associated with each of the first and second cam shafts for rotating the first and second cams into engagement with the respective first and second end mold members.

9. The apparatus of claim 8 wherein the first and second cam shafts each include a lower end portion received for rotation in a recess in the mold drag.

10. The apparatus of claim 9 wherein the first and second cam shafts each include an upper portion extending through said ceiling above the vacuum box, said ceiling including bushing means for rotatably receiving a length of each upper portion to permit rotation relative to said ceiling.

11. The apparatus of claim 10 wherein said rotator means comprises linkage means operatively connected to said upper portions above the vacuum box for rotating the first and second cam shafts and an actuator means coupled to the linkage means for actuating said linkage means to rotate the first and second cam shafts in unison.

12. The apparatus of claim 10 wherein the first and second cams are disposed on the respective first and second cam shaft between said lower end portion and said length of said upper portion.

13. The apparatus of claim 8 further including biasing means disposed between the ceiling of the vacuum box and the mold stack to bias the mold stack against the mold drag.

14. The apparatus of claim 13 wherein said biasing means includes a hold-down plate disposed atop the mold stack in a direction transverse to the parting line and spring means between the hold-down plate and the ceiling of the vacuum box.

* * * * *

UNITED STATES PATENT AND TRADEMARK OFFICE

CERTIFICATE OF CORRECTION

PATENT NO. : 5,029,630

DATED : July 9, 1991

INVENTOR(S) : Karl D. Voss

It is certified that error appears in the above-identified patent and that said Letters Patent is hereby corrected as shown below:

Title page, item [54] and col. 1, delete title and substitute therefor --DIFFERENTIAL PRESSURE, COUNTERGRAVITY CASTING APPARATUS USING A VERTICALLY PARTED MOLD STACK AND MOLD STACK CLAMP MECHANISM--.

Signed and Sealed this

Fourteenth Day of September, 1993

Bruce Lehman

*Attest:*

BRUCE LEHMAN

*Attesting Officer*

*Commissioner of Patents and Trademarks*